US011614304B2

(12) United States Patent
Shirlen

(10) Patent No.: US 11,614,304 B2
(45) Date of Patent: Mar. 28, 2023

(54) HANDS-FREE LONG-GUN CARRIER

(71) Applicant: Andrew M. Shirlen, Chapel Hill, NC (US)

(72) Inventor: Andrew M. Shirlen, Chapel Hill, NC (US)

( * ) Notice: Subject to any disclaimer, the term of this patent is extended or adjusted under 35 U.S.C. 154(b) by 0 days.

(21) Appl. No.: 17/359,777

(22) Filed: Jun. 28, 2021

(65) Prior Publication Data

US 2022/0042766 A1 Feb. 10, 2022

Related U.S. Application Data

(60) Provisional application No. 63/062,711, filed on Aug. 7, 2020.

(51) Int. Cl.
*F41C 33/00* (2006.01)

(52) U.S. Cl.
CPC ..... *F41C 33/007* (2013.01); *F41C 33/002* (2013.01)

(58) Field of Classification Search
CPC ..... F41C 33/00; F41C 33/002; F41C 33/007; F41C 33/0236; F41C 33/001; F41C 33/005; Y10S 224/913
USPC ..... 224/913, 247
See application file for complete search history.

(56) References Cited

U.S. PATENT DOCUMENTS

| | | | | |
|---|---|---|---|---|
| 475,640 | A | 5/1892 | Unger | |
| RE16,238 | E | 12/1925 | Thompson | |
| 3,022,898 | A * | 2/1962 | Loeb | F41A 23/18 248/230.8 |
| 3,501,074 | A | 3/1970 | Emerick | |
| 4,431,122 | A | 2/1984 | Garmong | |
| 5,642,847 | A | 7/1997 | DeMeo et al. | |
| 5,669,170 | A | 9/1997 | Norris | |
| 5,881,487 | A | 3/1999 | Chalker | |
| RE37,111 | E * | 3/2001 | Barron | A45F 5/00 224/678 |
| 8,025,193 | B1 * | 9/2011 | Gornall, Jr. | A45F 5/00 224/268 |
| 9,243,867 | B2 | 1/2016 | Ponder | |
| 9,683,809 | B2 | 6/2017 | Fowler | |
| 9,714,810 | B1 | 7/2017 | Nowlin | |
| 9,797,679 | B2 | 10/2017 | Ponder | |
| 10,228,216 | B2 | 3/2019 | Reeves | |
| 10,775,130 | B1 * | 9/2020 | Cass | F41C 33/007 |
| 2011/0042427 | A1 | 2/2011 | Goransson-Sonnefelt | |
| 2013/0146628 | A1 | 6/2013 | Gump | |

* cited by examiner

*Primary Examiner* — Corey N Skurdal
(74) *Attorney, Agent, or Firm* — Wood Herron & Evans LLP

(57) ABSTRACT

Provided is a hands-free long-gun carrying device having a support plate supported at a user's chest and a gripping structure on the support plate configured to releasably engage and support a long-gun in a ready position. The gripping structure includes first and second jaw members substantially open toward a front direction. At least one of the jaw members is resiliently deflectable to receive and grip a porting of a long-gun inserted between the jaw members.

14 Claims, 21 Drawing Sheets

HANDS-FREE LONG-GUN CARRIER

RELATED APPLICATIONS

This application claims priority to U.S. Provisional Patent Application No. 63/062,711, filed Aug. 7, 2020, and incorporates the same herein by reference.

TECHNICAL FIELD

This invention relates to an apparatus for carrying a long-gun in a ready position supported on the user's chest, such as while walking or hunting.

BACKGROUND

Various devices have been used to carry firearms on a person's body. Handguns are usually carried in a holster, while long-guns (shotguns and rifles) are usually carried with a sling. Most slings allow the long-gun to hang by gravity and require significant movement of the gun to be moved into a firing position.

A few devices have been proposed for holding a long-gun in the "high ready" position, but these have various shortcomings, including the size of the device (requiring use with a full PALS-system vest) and ease/speed of deployment to a firing position (requiring release of multiple buckles, snaps, hook-and-loop fasteners, and/or flaps). Some of these rely in whole or in part on gravity to keep the long-gun in the device and are, thus, dependent on orientation for proper function.

SUMMARY OF THE INVENTION

The present invention provides an apparatus for hands-free carry of a long-gun in the high ready position that securely holds the firearm at the user's chest while sitting or standing, or while walking, bending over, climbing, wading, or other movement, but allows rapid release and deployment to a firing position.

The invention provides a hands-free long-gun carrying device having a support plate supported at a user's chest and a gripping structure on the support plate configured to releasably engage and support a long-gun in a ready position. The gripping structure includes first and second jaw members substantially open toward a front direction. At least one of the jaw members is resiliently deflectable to receive and grip a porting of a long-gun inserted between the jaw members.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
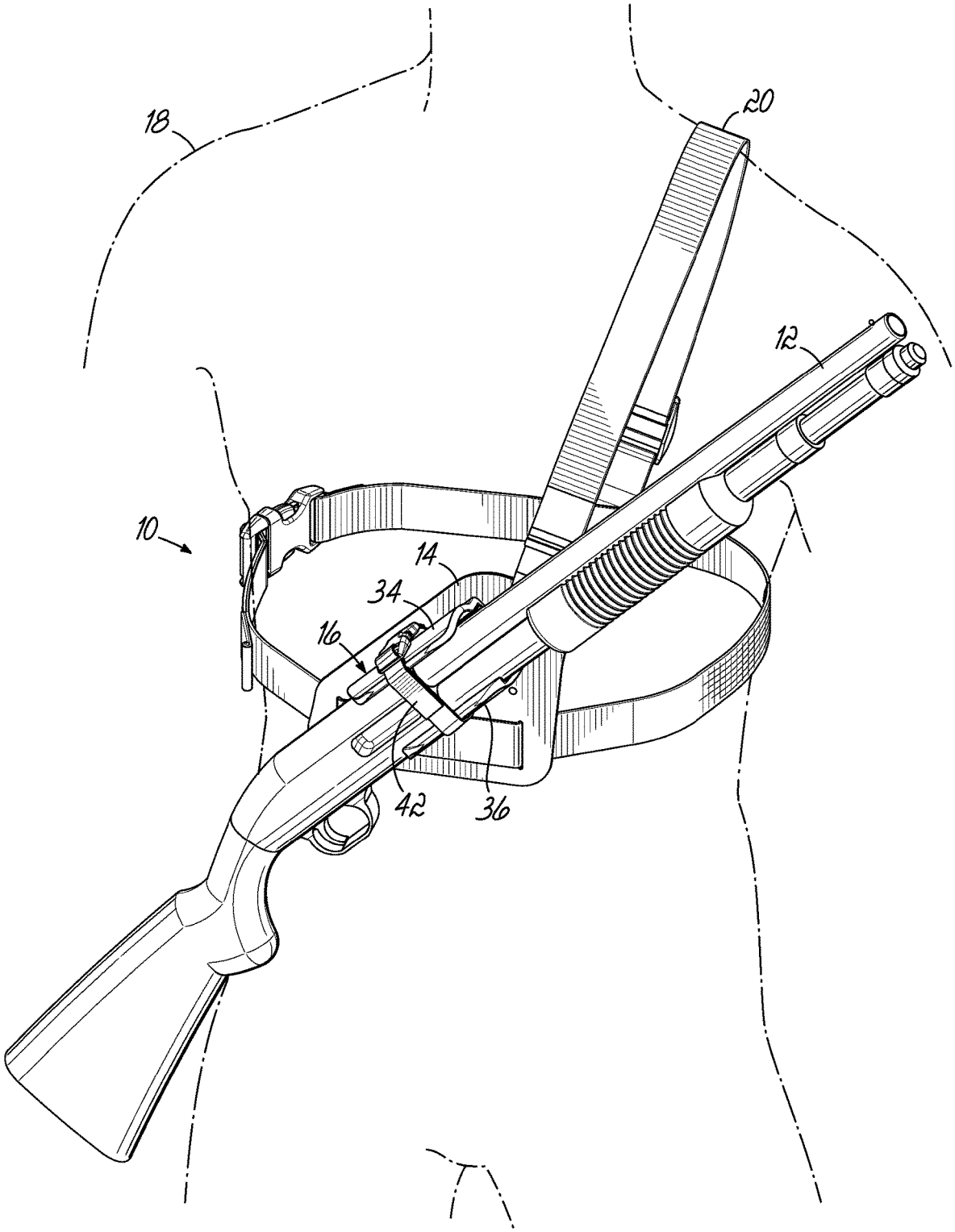
FIG. 1 is a pictorial view of an embodiment of the present invention shown on the torso of a human user (depicted in phantom line)

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

When in reference to a firearm, "forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner. When in reference to a person or body, "forward" will indicate the ventral side and direction the person is facing, unless otherwise specifically indicated. "Rearward" will indicate the dorsal side and direction behind the person, unless otherwise specifically indicated.

Figure 2:
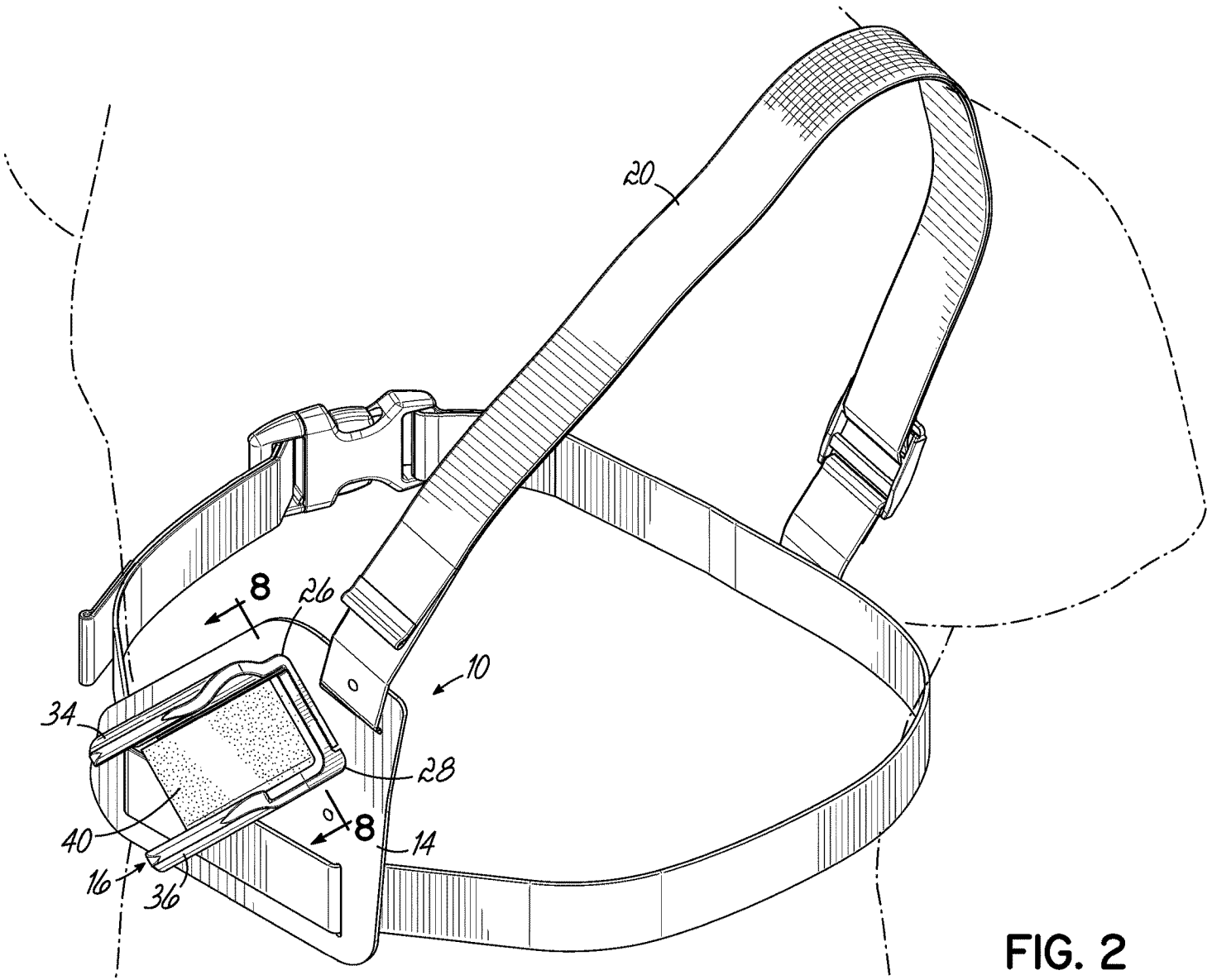
FIG. 2 is a close-up pictorial view thereof with the firearm removed.

Referring first to FIG. 1, therein is shown an apparatus 10 according to one embodiment of the present invention. The apparatus 10 provides a device for carrying a long-gun 12 in a "high ready" position that allows fast and easy deployment. As used herein, "long-gun" includes common rifles and shotguns, as well as firearms otherwise classified, such as pistol-grip-only "shotguns." Referring now also to FIG. 2, the apparatus 10 includes a support plate or breastplate 14 and a gripping structure 16 mounted thereon. The breastplate 14 may be suspended on the torso 18 of a user using any suitable harness or arrangement of straps 20, buckles, and/or adjustment sliders. The straps 20 may be fixed or detachable to the breastplate 14 and may be adjustable according to any well-known mechanism to fit the torso 18 of the user. The breastplate 14 should be constructed of a rigid or semi-rigid material in order to provide torsional stability and support to the gripping structure 16 mounted thereon. The breastplate may integrated into an article of clothing or some other gear being worn. The required size and stiffness is only what is needed to make the operation of the apparatus 10 effective and reliable and is not limited to a separate member of any particular size, thickness, or material.

Figure 3:
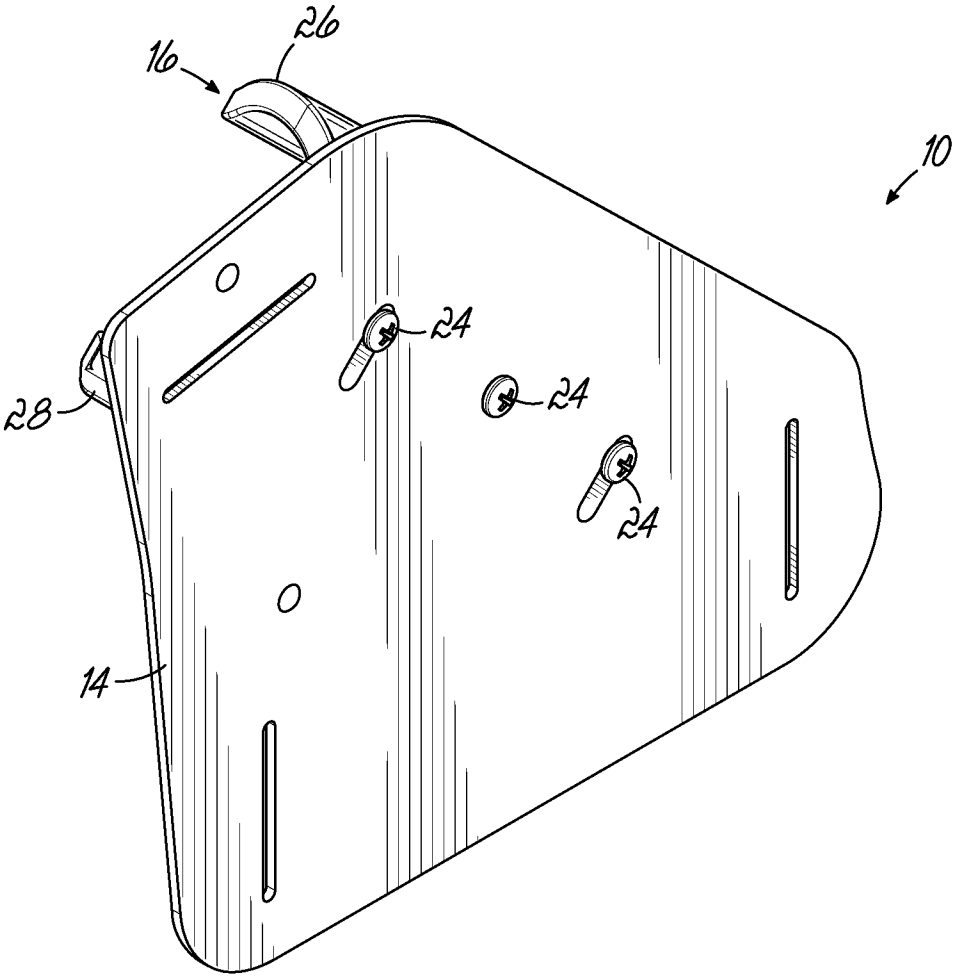
FIG. 3 is a pictorial rear view thereof with the support/harness straps removed.

Referring also to FIGS. 3 and 4, the gripping structure 16 may be attached to the breast plate 14 at a preselected or user-selected angle. This may be accomplished in a variety of ways, including having an array of openings 22 or slots in the breastplate 14 for receiving fasteners 24 or pivotal attachment devices. The gripping structure 16 provides a resilient clamping means or mechanism, typically open toward the front, for holding the long-gun against the user's chest, such as in a "high ready" position where the barrel is angled upward, as shown, or may be mounted at any other desired and appropriate angle for left-handed or right-handed use. For left-handed use, the breastplate 14 may be reversed, replaced with an alternate shape, or an ambidextrous shape used.

The gripping structure 16 provides a resilient clamping action on the long-gun, for example on the receiver, to hold it firmly in place. In general, it is open to the front, has a back that is secured to (or integral with) the breastplate 14, with upper and lower resiliently deflectable jaws that firmly grip top and bottom surfaces of the receiver area of the long-gun 12 near its natural center of gravity. The spacing and/or spring force of the jaws may be adjustable, as is described in more detail below. The gripping structure 16 may take on different forms, several example embodiments of which are described herein.

Figure 4A:
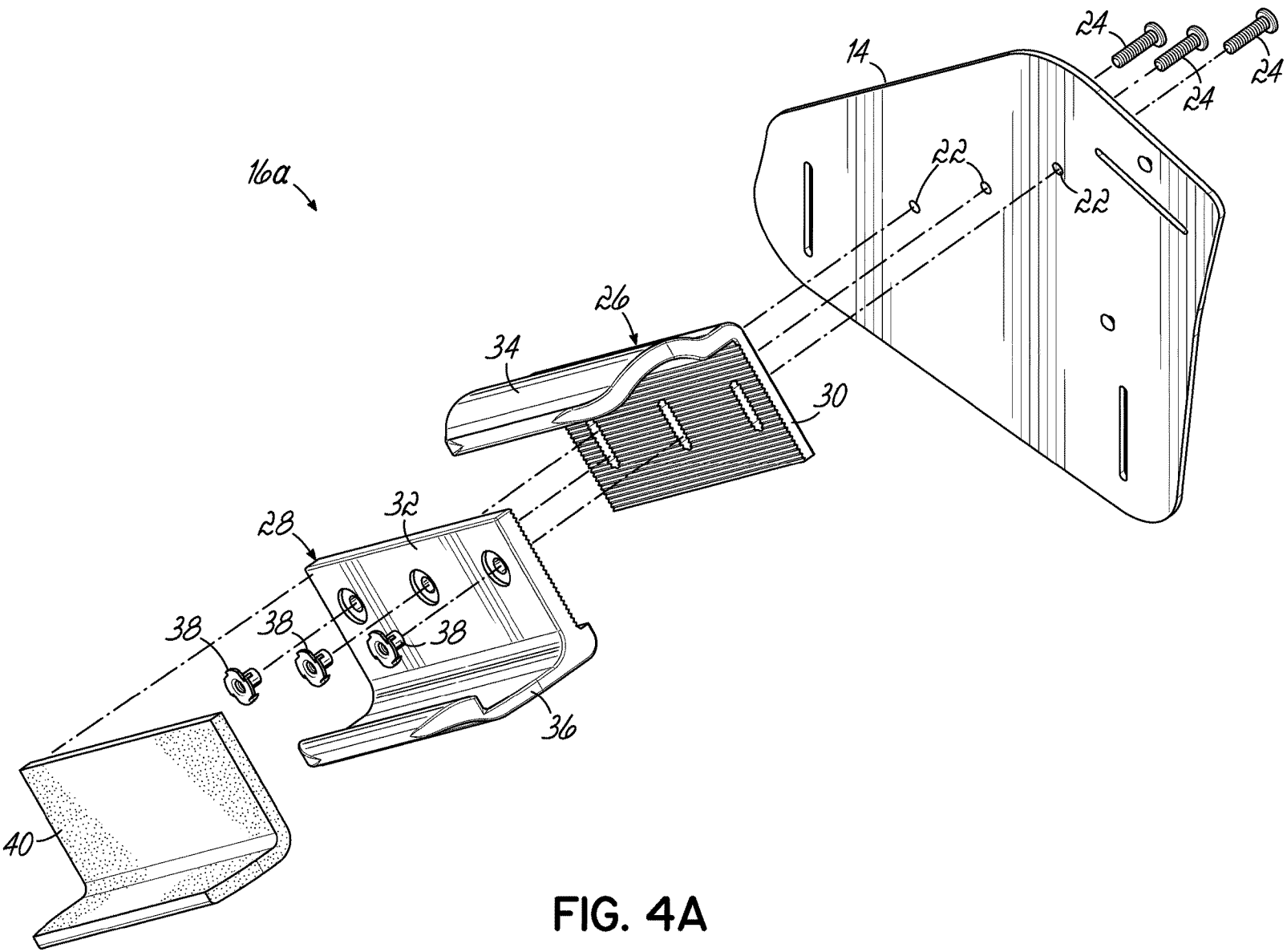
FIG. 4A is a front pictorial exploded view of the breastplate and gripping structure of this embodiment.
Figure 4B:
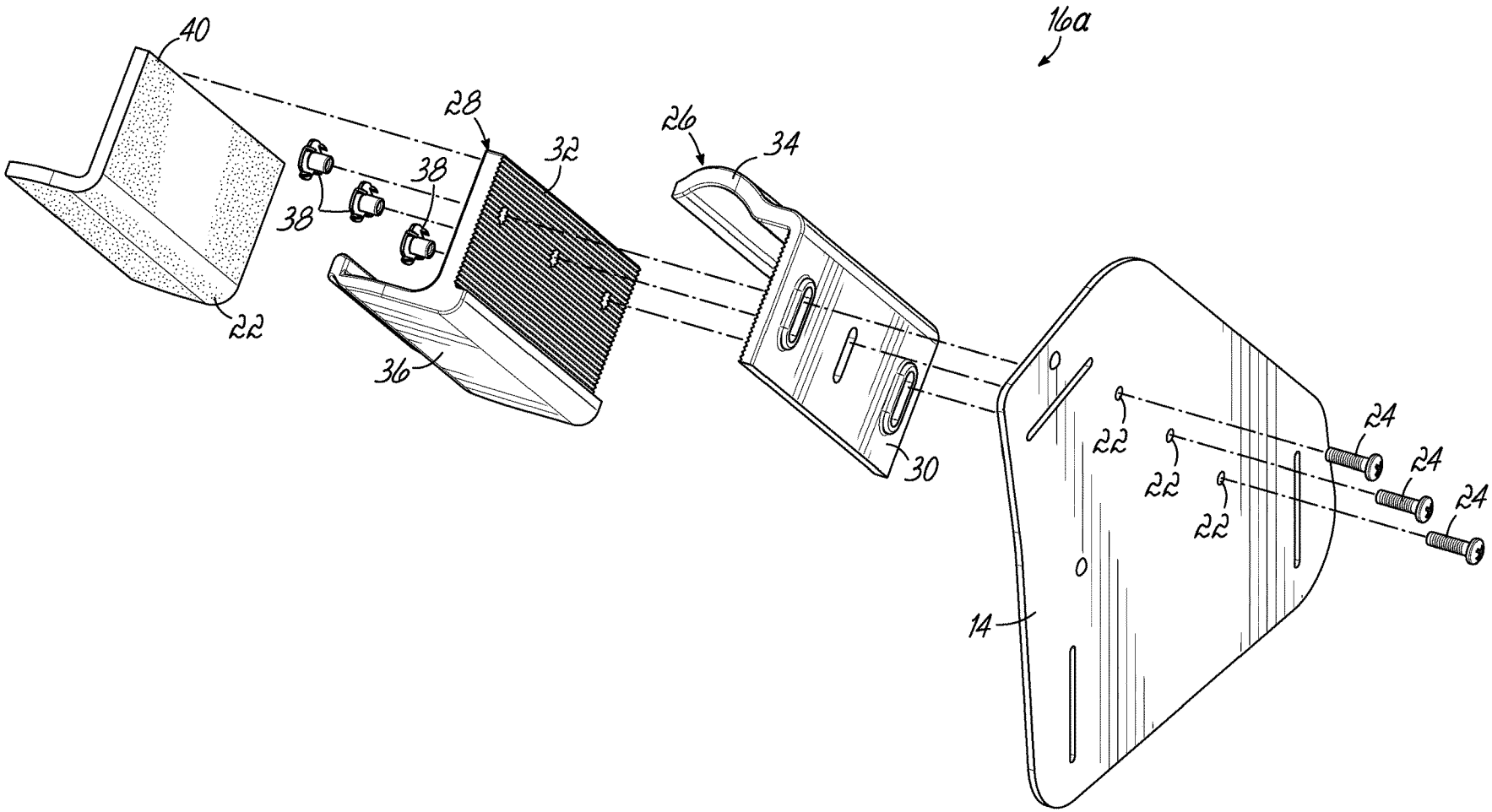
FIG. 4B is a rear pictorial exploded view thereof.

Referring now in particular to FIGS. 4A and 4B, therein is shown a gripping structure 16A according to a first embodiment of the invention. In this embodiment, the gripping structure 16A includes upper and lower jaw members 26, 28. Each includes an overlapping back portion 30, 32 that adjustably engages using, for example, interlocking splines. Each of the jaw members 26, 28 include jaw portions 34, 36 that extend from the respective back portion 30, 32. The jaw members 26, 28 may be held together (and to the breastplate 14) by fasteners 24. The fasteners 24 may engage, for example, captive nuts 38, may thread into one of the jaw members 26, 28, or may be Chicago screws (barrel screws). The back portion 32 of the jaw member 28 that comes into contact with the long-gun 12 and/or the inner surface of one or both jaw portions 34, 36 may be padded with a resilient material 40. The resilient material 40 may be rubber or a synthetic material, such as high density neoprene. In this embodiment, spacing between the jaw portions 34, 36 may be adjusted by the relative positions of the upper and lower jaw members 26, 28 and secured with the fasteners 24, 38. Also in this embodiment, the material of the jaw portions 34, 36 may have inherent resiliency that provides a deflectable gripping force on the long-gun 12.

Figure 5:
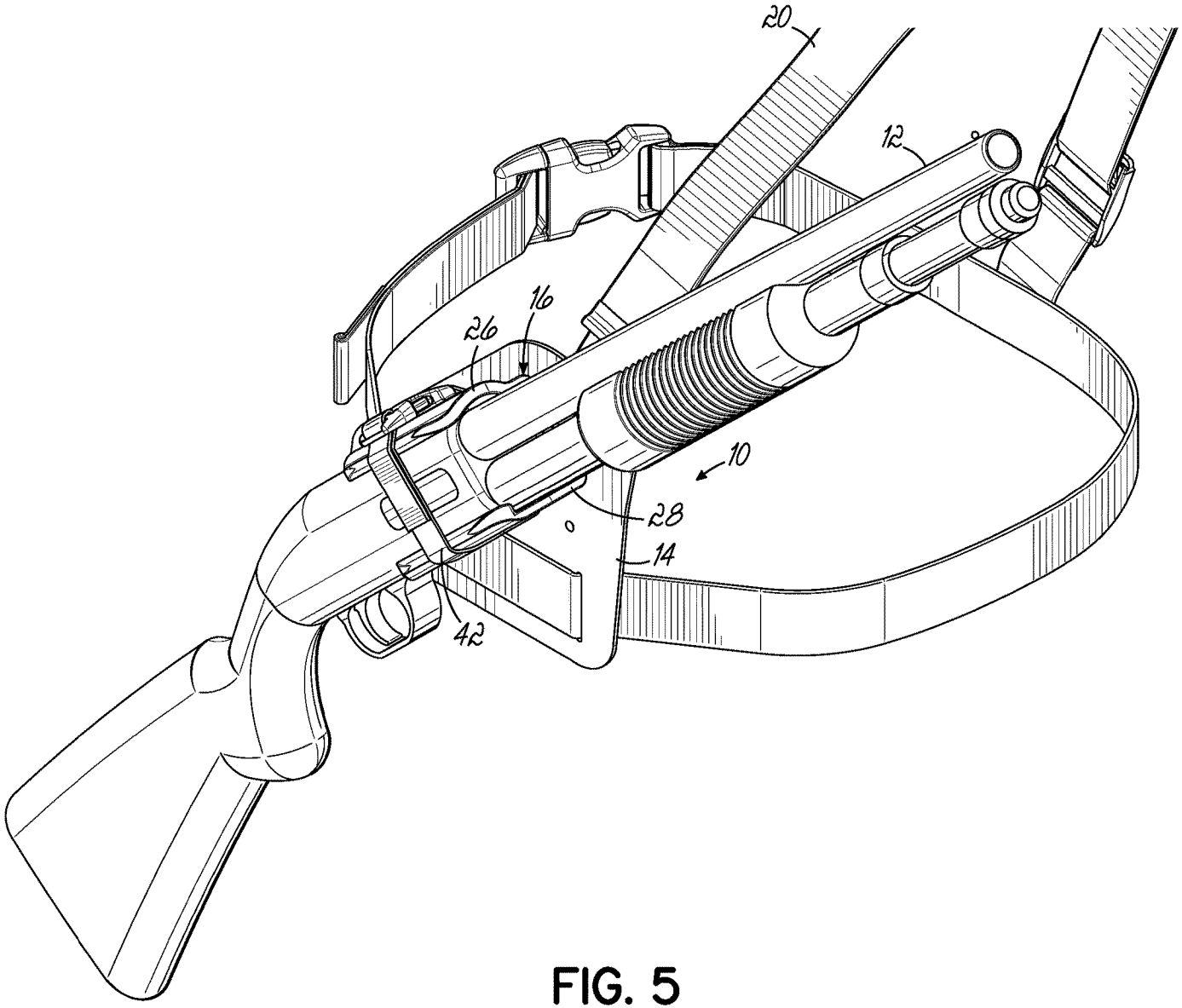
FIG. 5 is a pictorial enlarged partial view showing a long-gun (e.g., shotgun) secured in the device.
Figure 6:
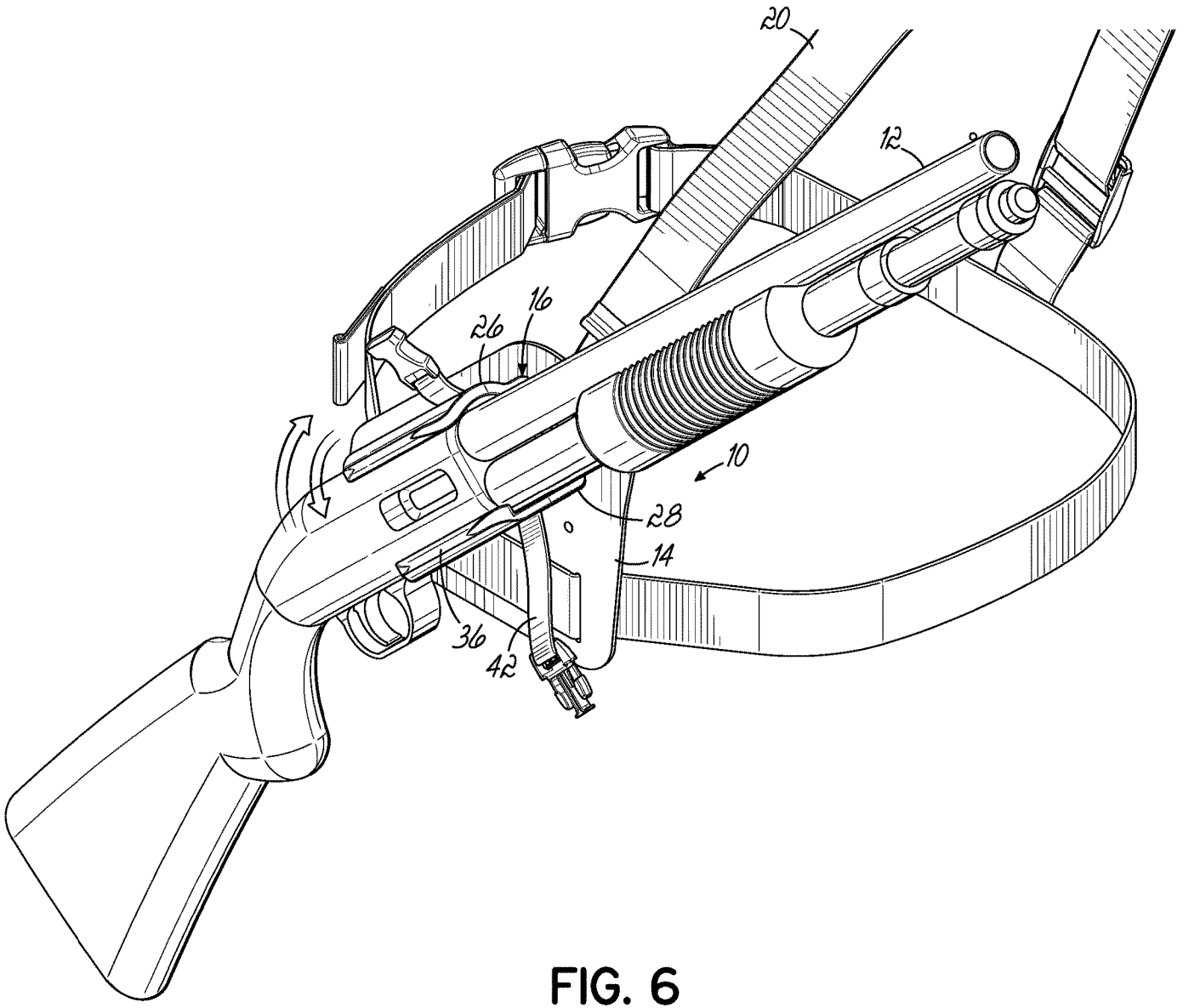
FIG. 6 is a similar view showing a retention strap unbuckled.
Figure 7:
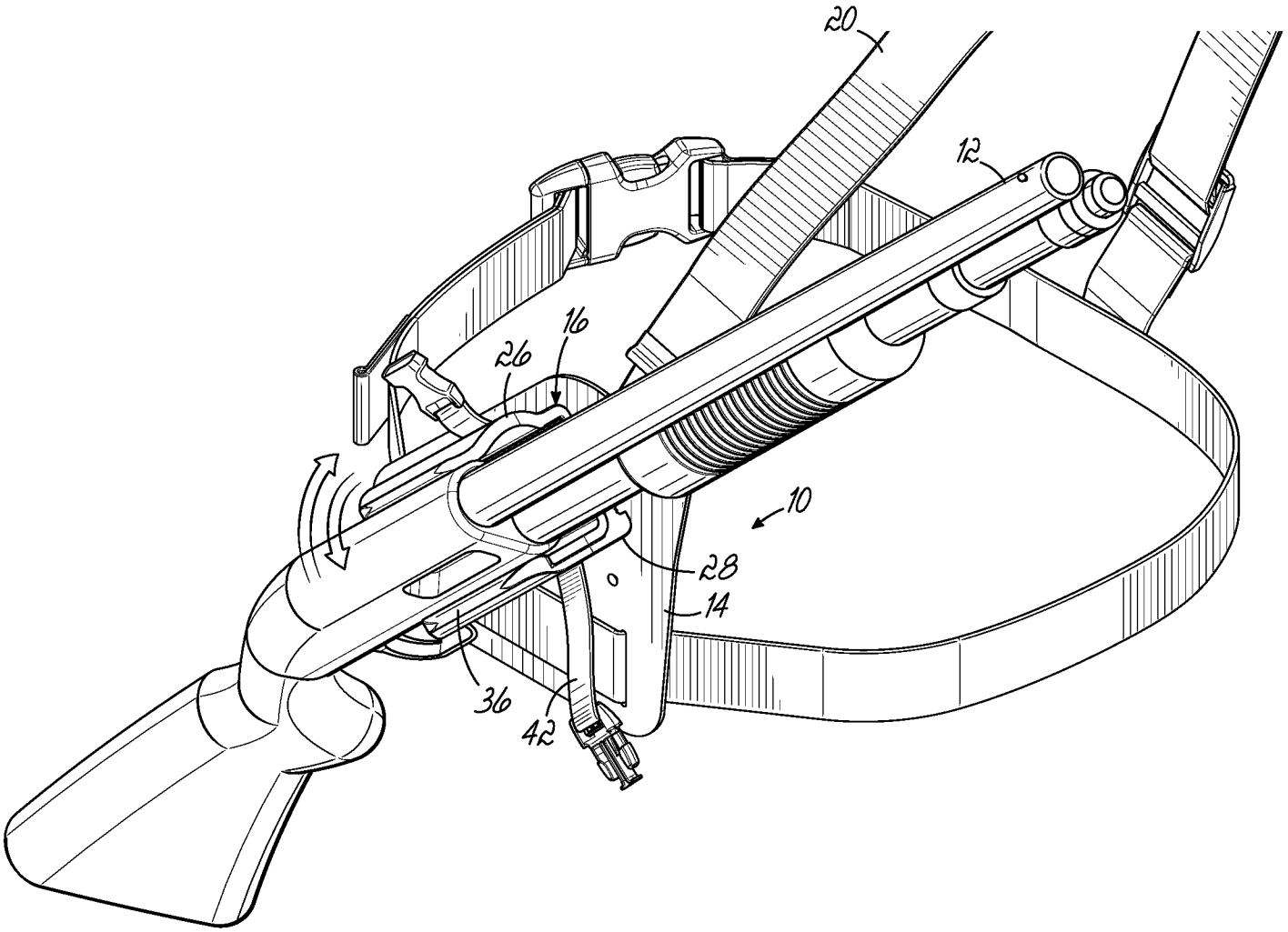
FIG. 7 is a similar view showing the long-gun being axially rotated into or out from the device.
Figure 8:
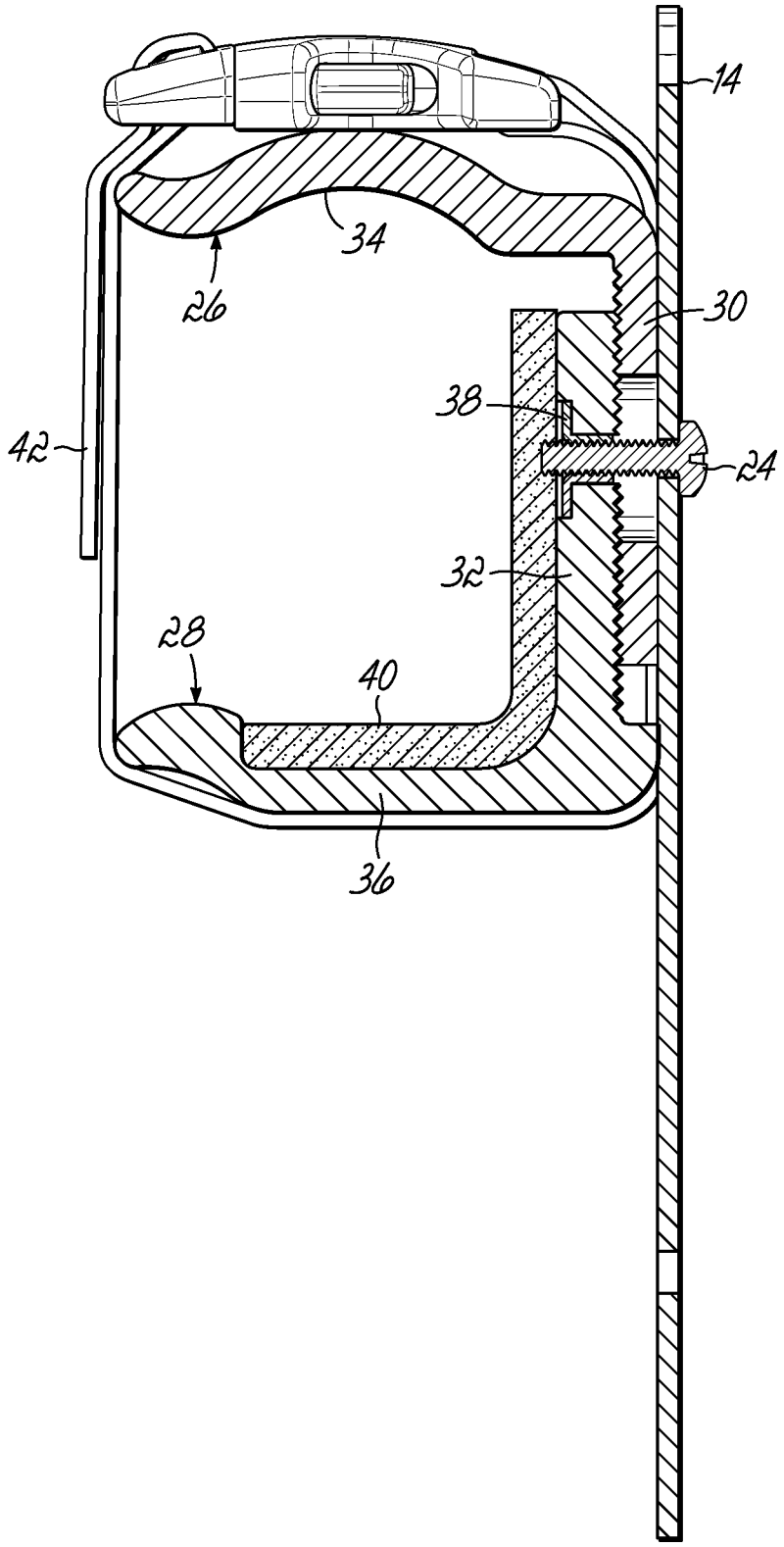
FIG. 8 is a cross-sectional view of the device without a long-gun therein taken substantially along line 8-8 of FIG. 2.
Figure 9:
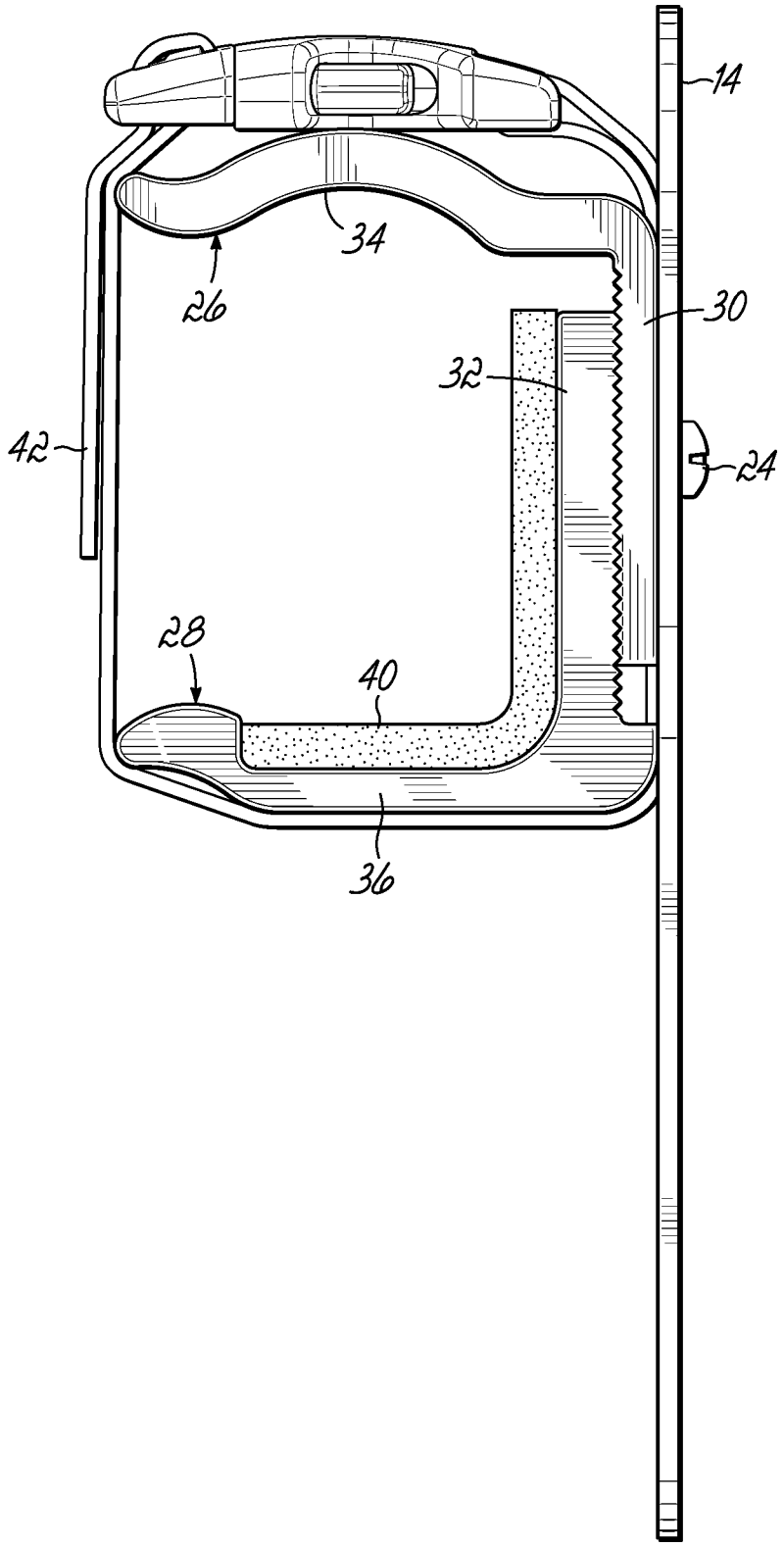
FIG. 9 is a similar end view thereof.
Figure 10:
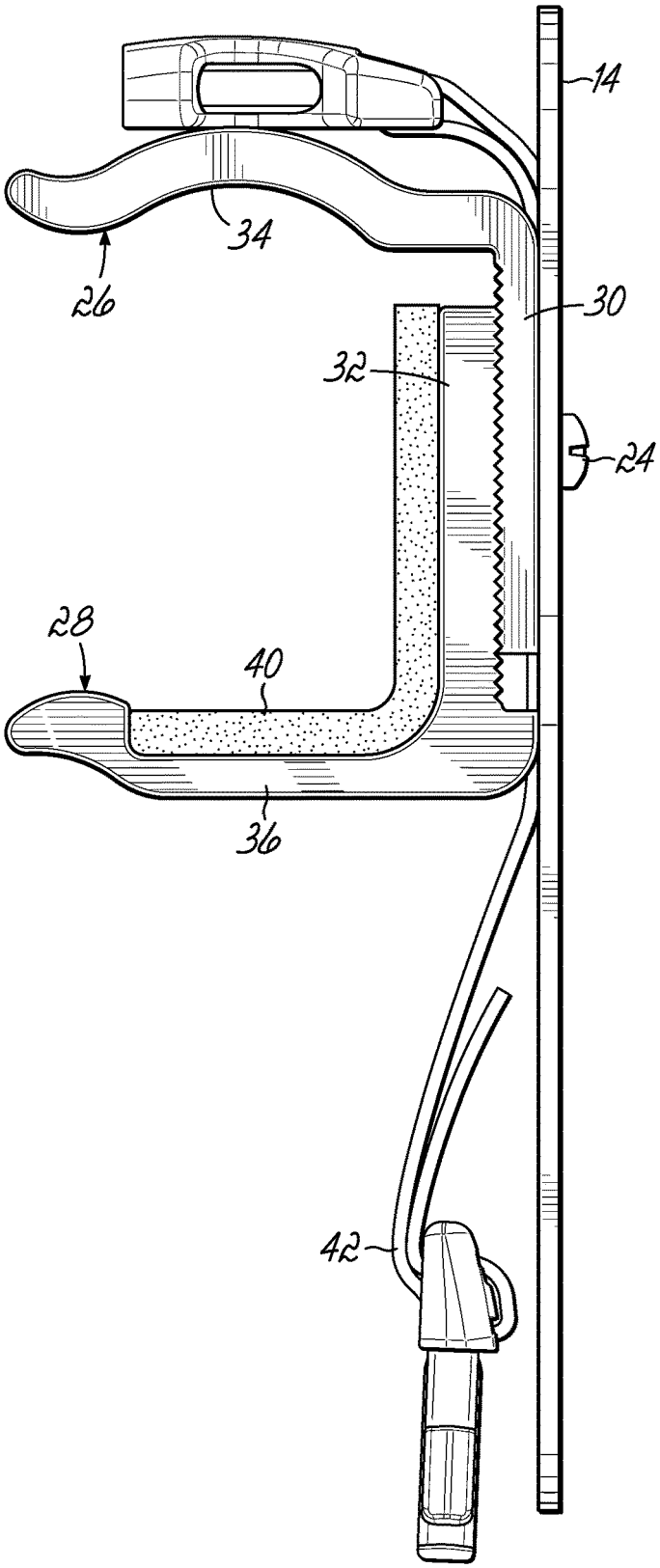
FIG. 10 is a similar view showing the retention strap unbuckled.
Figure 11:
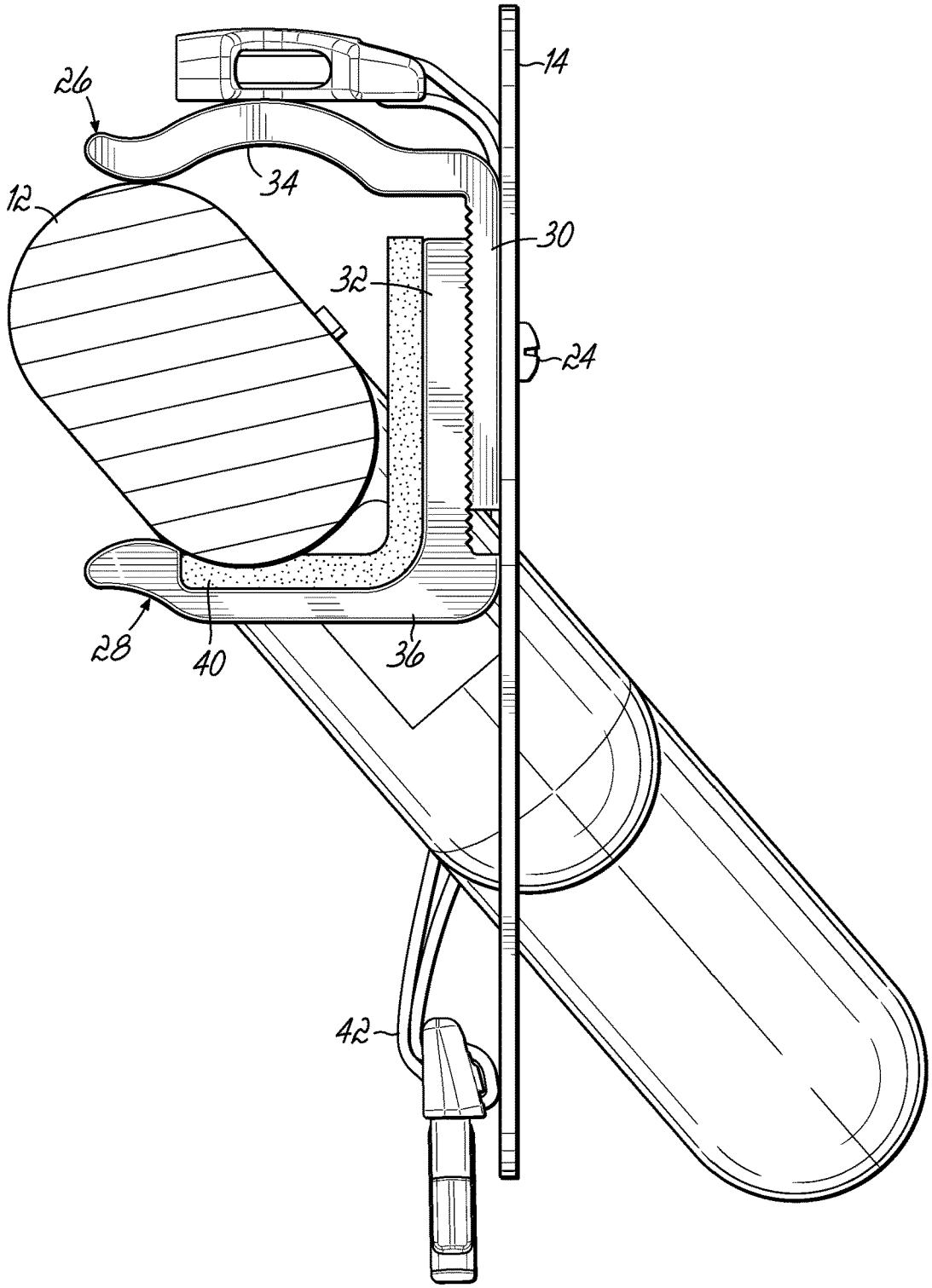
FIG. 11 is a similar view showing a long-gun in cross-section being "rolled" (axially rotated) into or out from the gripping structure.
Figure 12:
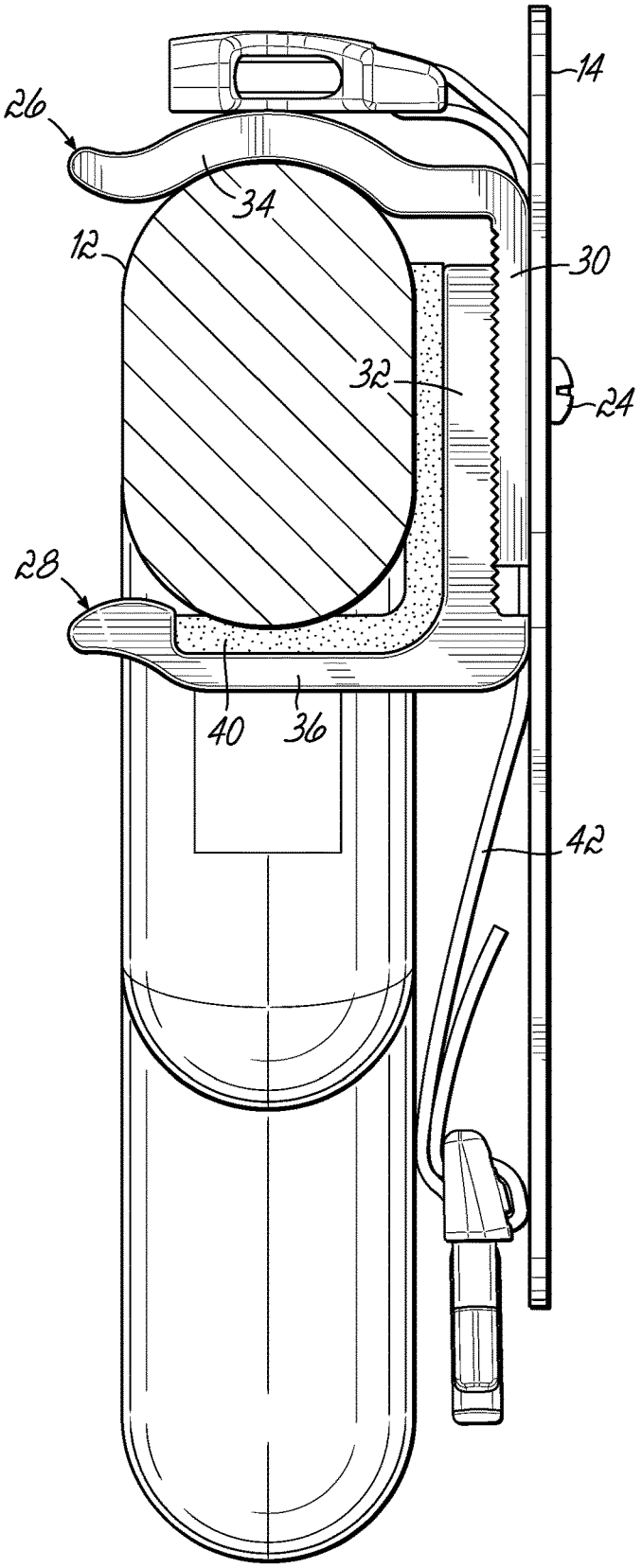
FIG. 12 is a similar view showing the long-gun gripped by the device.
Figure 13:
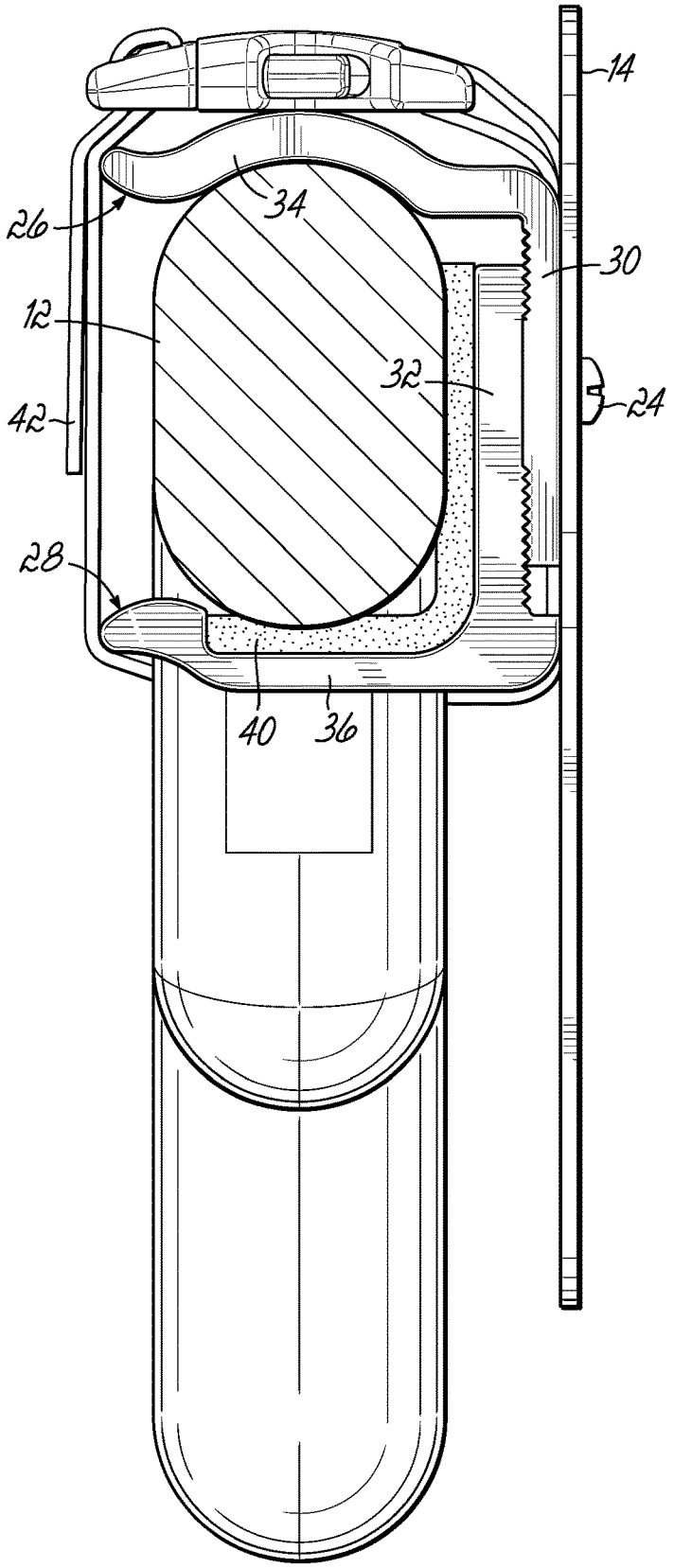
FIG. 13 is a similar view showing the long-gun gripped in the device and retention strap buckled.

Referring now to FIGS. 5 and 6, the long-gun 12 may be more securely held in the gripping structure 16 by a retention strap 42 that can be adjustably buckled in place (FIG. 5) or released (FIG. 6) to allow the long-gun 12 to be more quickly and readily accessed. Generally, the long-gun 12 will be securely held by the gripping structure 16 without the use of the retention strap 42. It is contemplated that the gripping structure 16 will hold a long-gun 12 with adequate security for sitting, standing, or general casual walking, wading, climbing, or bending movement, such as when hunting in a field or pathway or setting decoys in water. However, the retention strap 42 may provide an extra level of security during activities where rapid access to the long-gun 12 is unnecessary, such as when running, climbing over a fence or uneven terrain, or climbing to a tree stand.

As shown in FIGS. 7-13, the long-gun 12 may be inserted, for example, by "rolling" it generally along its longitudinal axis into position between the jaw portions 34, 36 of the gripping structure 16 to resiliently deflect one or both jaw portions 34, 36. Likewise, the long-gun 12 may be quickly removed by a similar axial "rolling" action to allow forward removal. When inserting, either the lower edge or upper edge of the long-gun 12 may be inserted first, with the opposite edge being "rolled" into place. Likewise with removal, either the top or bottom edge may be "rolled" out of the gripping structure 16.

Figure 14:
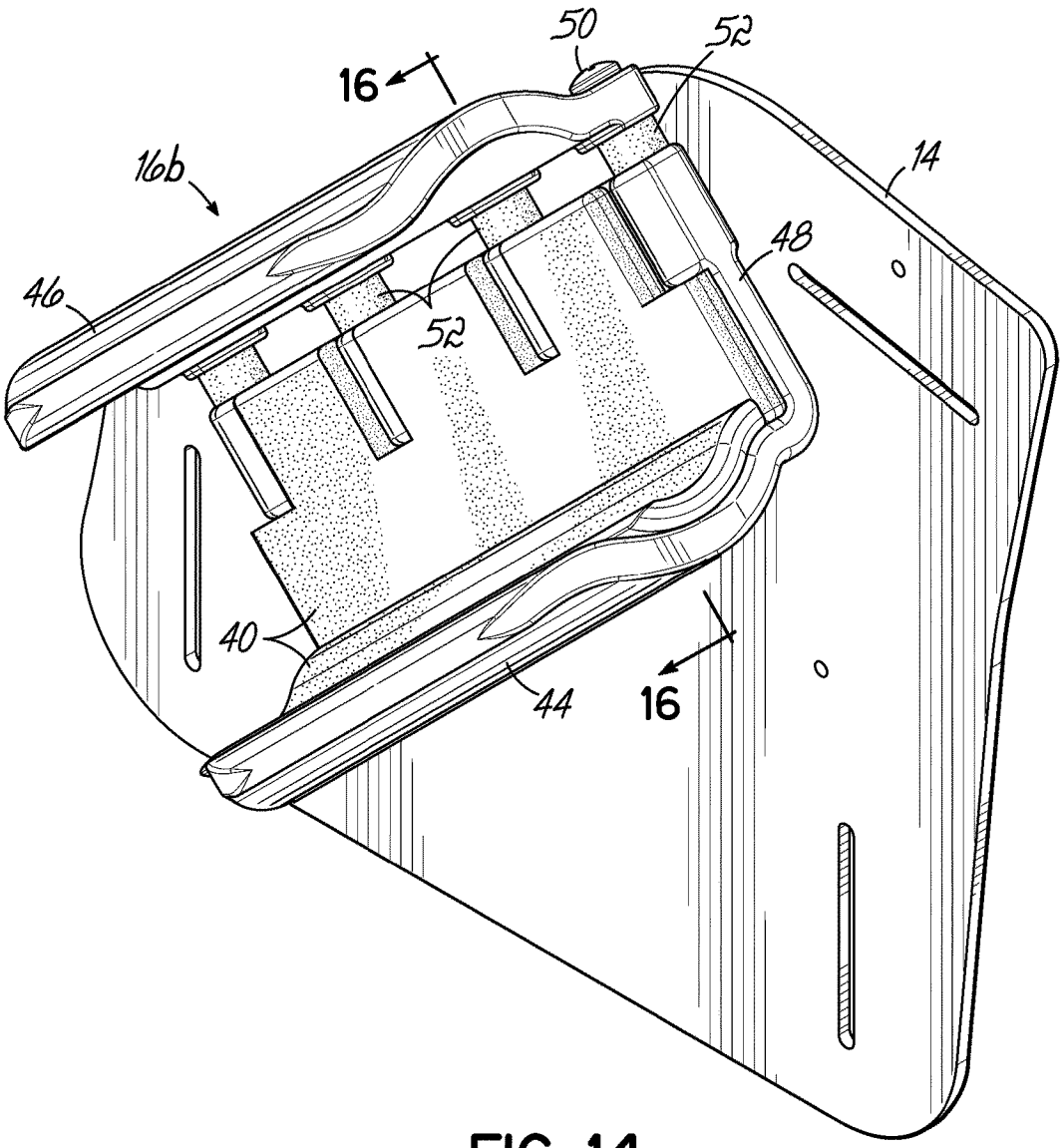
FIG. 14 is a pictorial view of a second embodiment of the invention.
Figure 15:
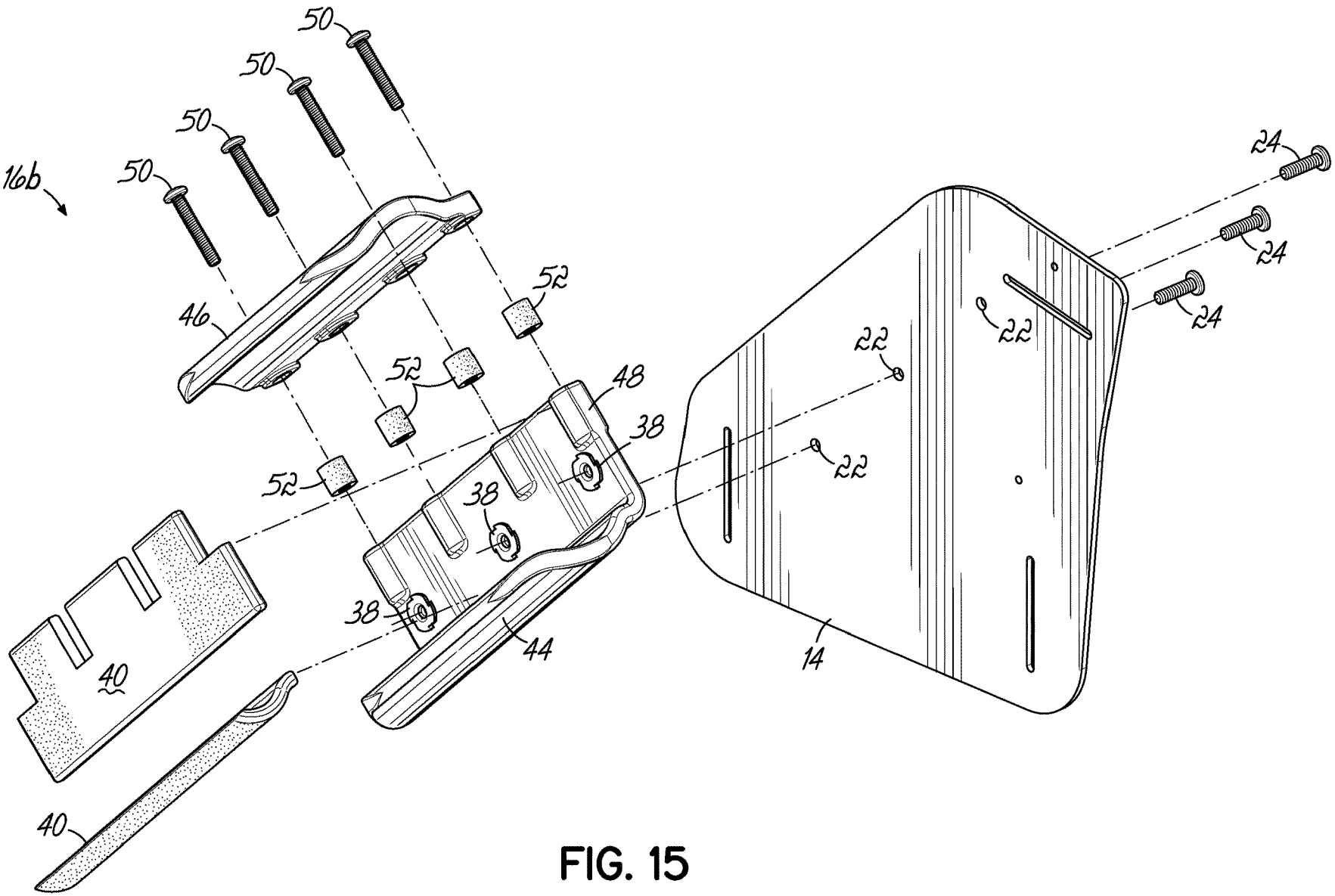
FIG. 15 is a pictorial front exploded view thereof.
Figure 16:
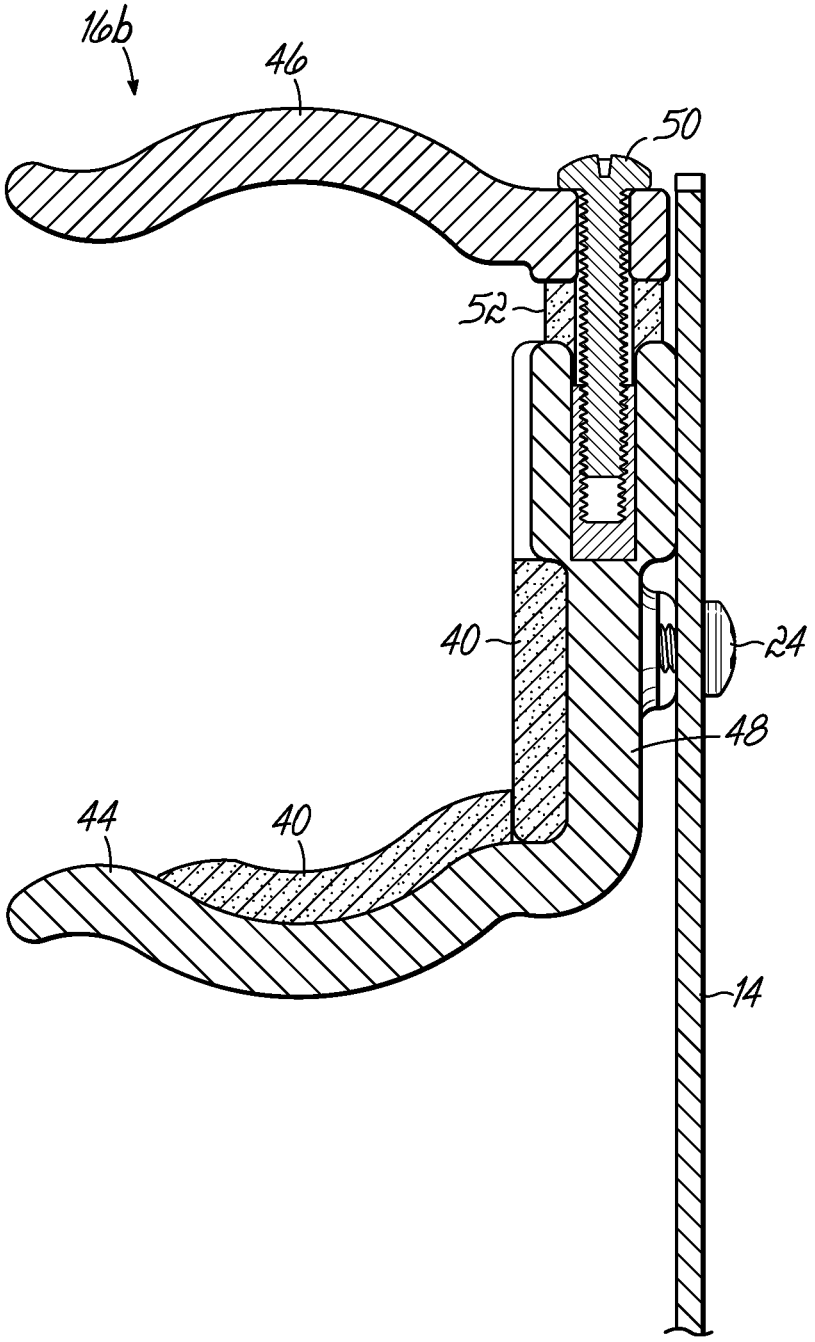
FIG. 16 is cross-sectional taken substantially along line 16-16 of FIG. 14.

Referring now to FIGS. 14-16, therein is shown an alternate embodiment gripping structure 16*b*. In this embodiment, a lower jaw member 44 is secured to the breastplate 14. An upper jaw member 46 is resiliently or hingedly secured to the back portion 48 of the lower jaw member 44 using threaded fasteners 50 attached through elastomeric spacers 52, allowing adjustment of both the relative spacing between the upper and lower jaws 44, 46 and resilient tension allowing flexing movement of the upper jaw 46 relative to the lower jaw 44 and breastplate 14. Additionally, the fasteners 50 may be adjusted individually to accommodate an angled or irregularly shaped receiver. The specific profile of the jaws 44, 46 may be selected to best accommodate a receiver having a square or rounded top and bottom edge profile(s). This embodiment may also include elastomeric material 40 covering some or all of the interior surfaces of the lower and/or upper jaw members 44, 46.

Figure 19:
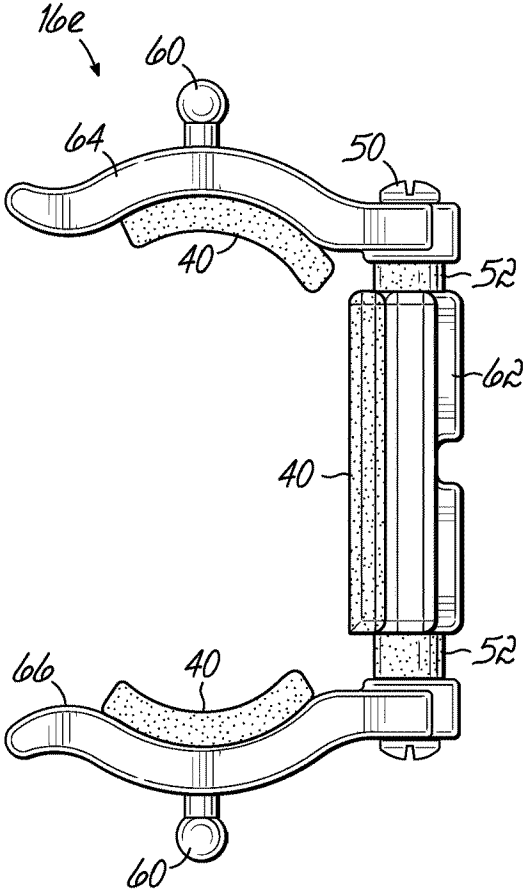
FIG. 19 is an end view of a fifth embodiment.
Figure 18:
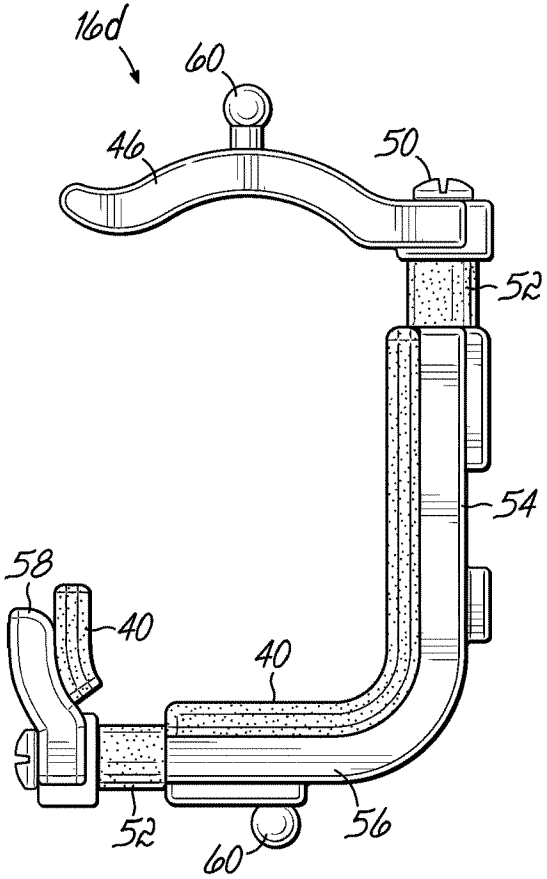
FIG. 18 is an end view of a fourth embodiment.
Figure 17:
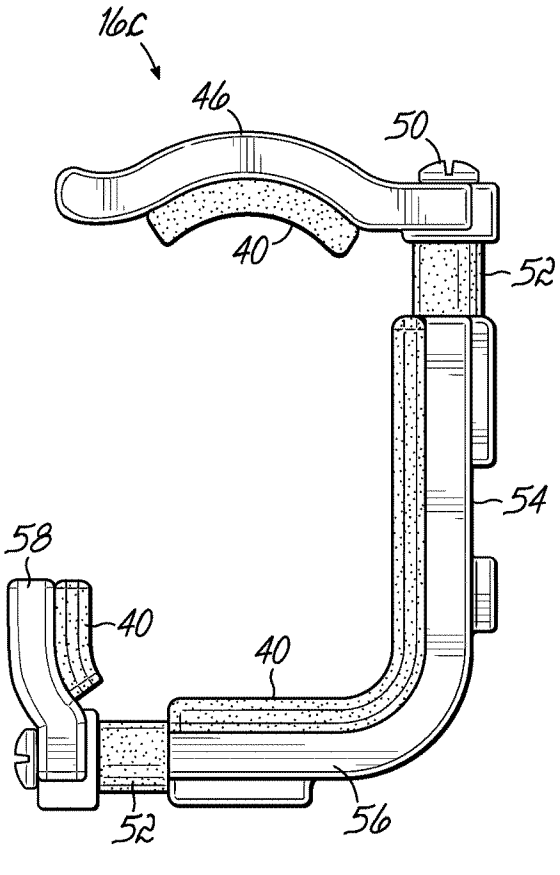
FIG. 17 is an end view of a third embodiment.

Referring now to FIGS. 17-19, therein are shown three additional embodiments of the gripping structure 16*c*, 16*d*, 16*e*. Referring to the embodiment of FIG. 17, the gripping structure 16*c* includes a central mounting member 54 which secures to the breastplate (not shown) and is L-shaped in cross-section with a lower shelf portion 56 to support the long-gun (not shown). An upper jaw 46 is resiliently secured to the central mounting member 54 similar to that in the embodiment shown in FIGS. 14-16. A similarly attached lower edge member 58 is attached to the lower shelf portion 56 of the central mounting member 54 and provides similar resilient gripping force. The embodiment shown in FIG. 18 of the gripping structure 16*d* is similar in all the above respects, but further includes one or more protrusions 60 that allow the user to facilitate resilient relative movement between the lower shelf portion 56 and upper jaw 46.

Referring now to FIG. 19, therein is shown another alternate embodiment gripping structure 16*e* in which a central mounting plate 62 attaches to the breastplate (not shown) and has upper and lower resiliently attached jaw portions 64, 66 attached thereto using a similar fastener and elastomeric spacer construction. As previously described, the position or tension of the fasteners 50 may be individually adjusted to better accommodate or more securely grip long-gun receivers of different sizes and/or shapes.

Figure 20:
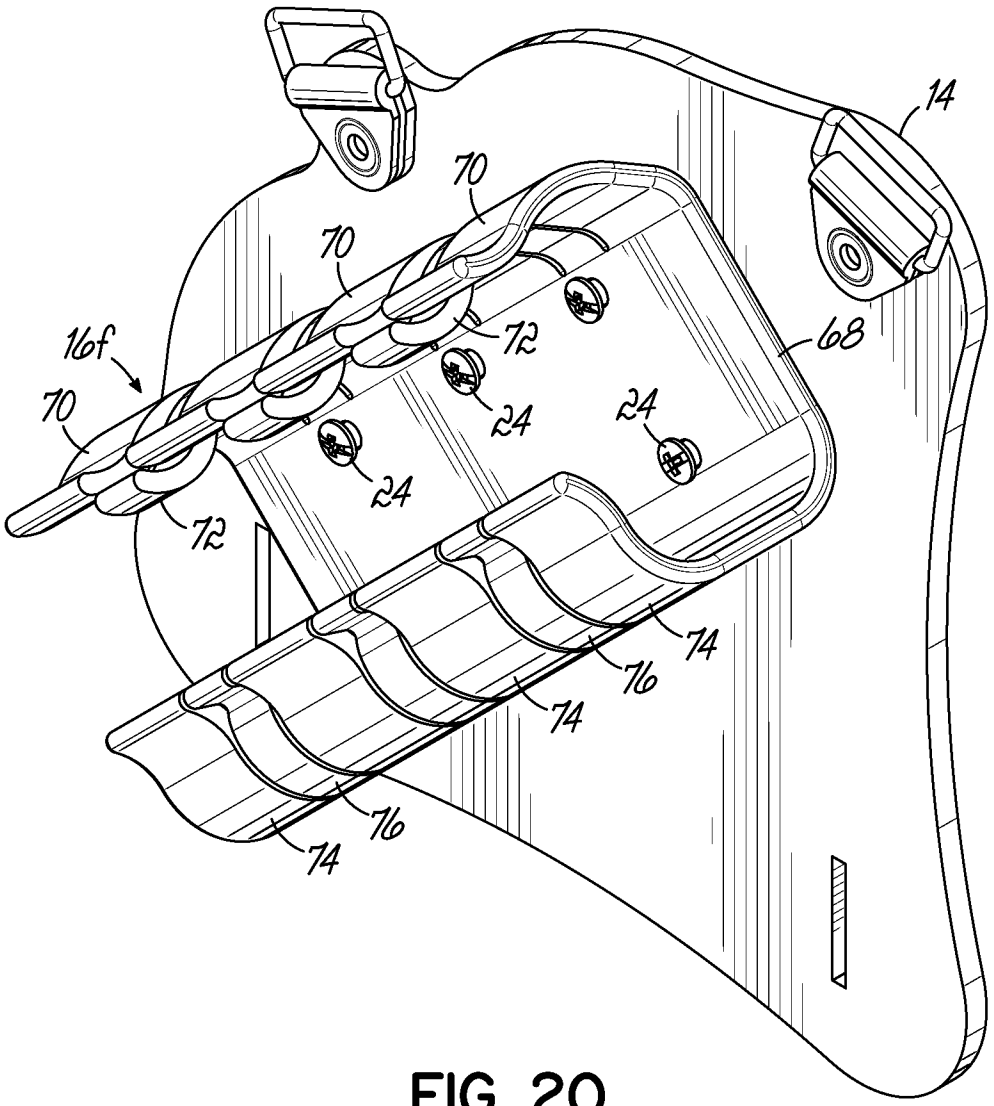
FIG. 20 is a pictorial view of a sixth embodiment.
Figure 21:
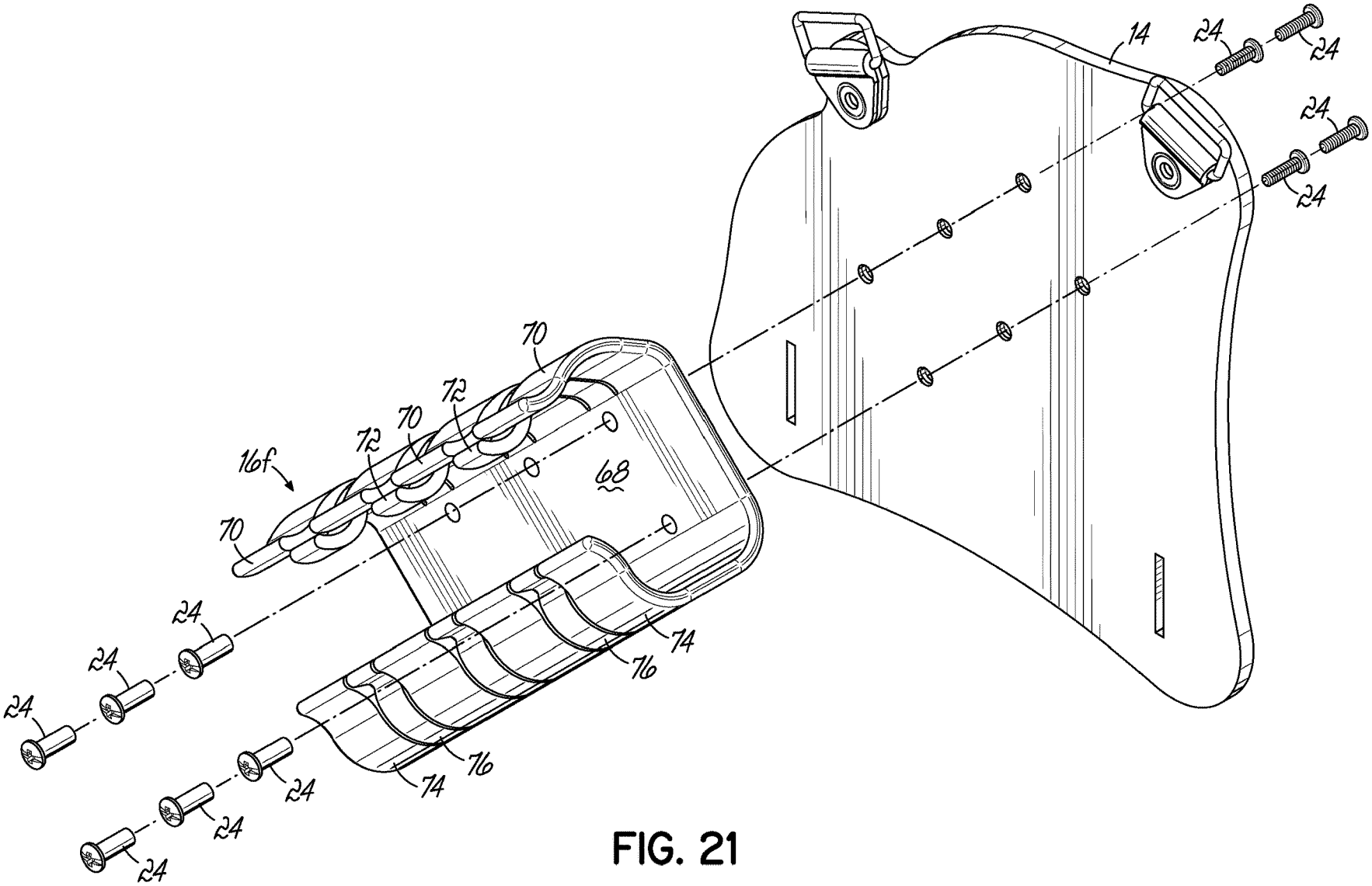
FIG. 21 is a pictorial front exploded view thereof.
Figure 22:
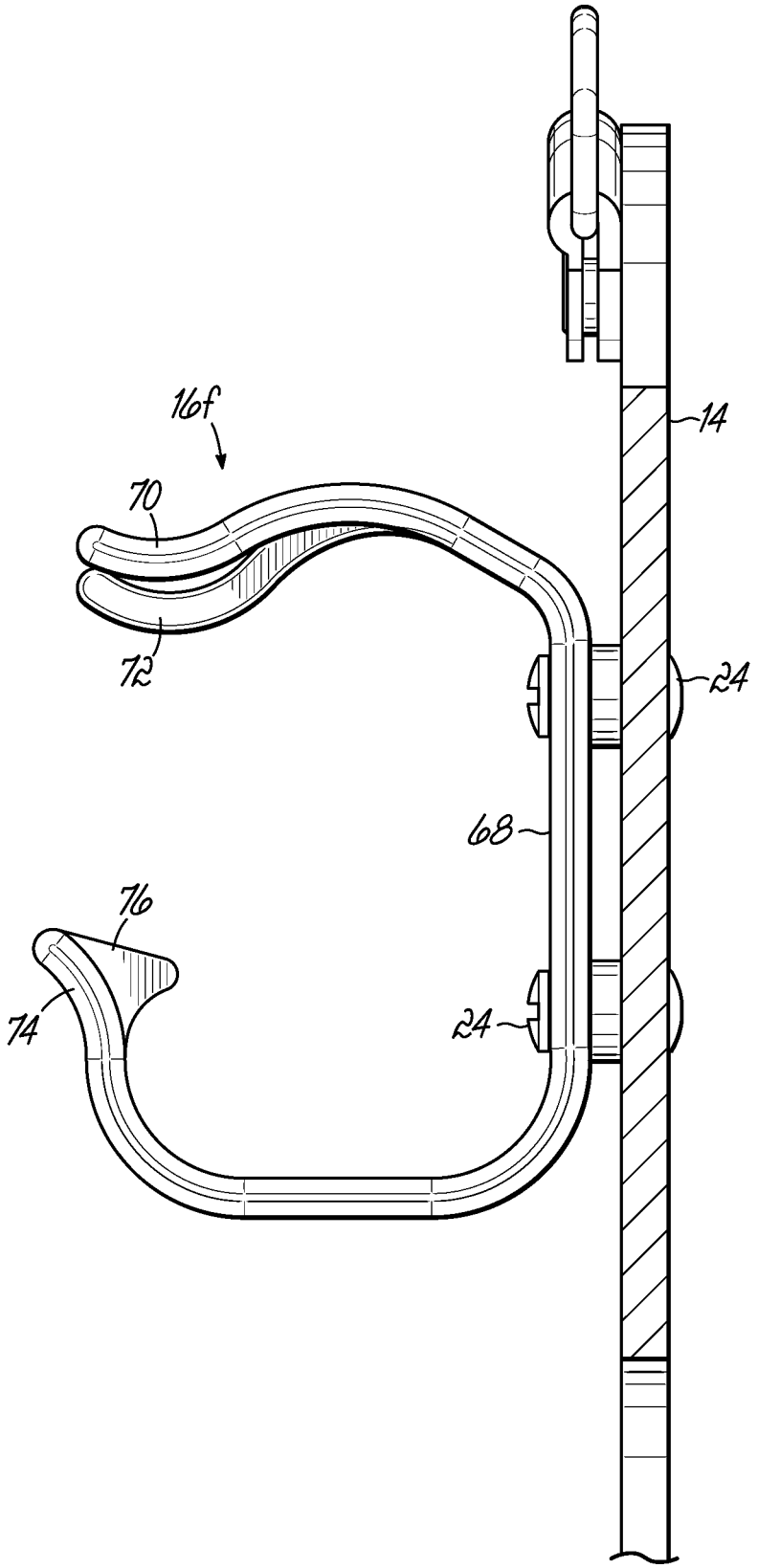
FIG. 22 is an end view thereof.

FIGS. 20-22 show yet another embodiment of a gripping structure 16*f* mounted on a breastplate 14. The gripping structure 16*f* may be attached to the breastplate 14 such as with fasteners that thread into a respective part, or that are secured with a captive nut, free nut, or barrel nut. In this embodiment, the gripping structure 16*f* may be a unitary part having a back portion 68 with upper and lower jaw portions 70, 72 extending from it. the jaw portions 70, 72 may include a series of separately resiliently bendable or deflectable "fingers" 70, 72, 74, 76. Alternating fingers 72, 76 on the top and/or bottom may have different profiles to more securely hold the long-gun 12 in place and/or to accommodate an irregular shape.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A hands-free long-gun carrying device, comprising:

a support plate supported at a user's chest; and a gripping structure on the support plate configured to releasably engage and support a long-gun in a port arms position, the gripping structure comprising:

a back portion;

upper and lower spaced apart resiliently deflectable jaw members defining an opening facing substantially forward relative to the user's chest, the upper jaw member having an upper jaw portion and a downturned lip portion along a forward edge of the upper jaw portion, the lower jaw member having a lower jaw portion and an upturned lip portion along a forward edge of the lower jaw portion;

the back and jaw members configured to resiliently receive therein a receiver of the long-gun with the long-gun in the port arms position such that the back portion engages a rear surface of the receiver, the upper jaw portion engages an upper surface of the receiver, the lower jaw portion engages a lower surface of the receiver, the downturned lip portion engages an upper forward surface of the receiver, and the upturned lip portion engages a lower forward surface of the receiver.

2. The device of claim 1, wherein the jaw members are separate parts that are adjustably spaced apart to accommodate long-guns of varied size.

3. The device of claim 1, wherein the resilient deflectability of at least one of the jaw members is adjustable.

4. The device of claim 1, wherein at least a portion of the gripping structure is made of a resiliently flexible material.

5. The device of claim 4, wherein at least one of the jaw members is made of a resiliently flexible material.

6. The device of claim 1, wherein at least one of the jaws includes a resilient hinge connection.

7. The device of claim 1, wherein both jaw members are a unitary member.

8. The device of claim 1, further comprising a releasable strap extending between jaw members to fixedly secure the long-gun in the gripping structure.

9. The device of claim 8, wherein the releasable strap incudes a buckle.

10. The device of claim 1, wherein the support plate is supported on the user's chest by a harness.

11. The device of claim 1, wherein the gripping structure is selectively positionable on the support plate.

12. The device of claim 11, wherein an angle orientation of the gripping structure is selectively positionable on the support plate.

13. The device of claim 1 wherein each of the upper and lower jaw members is generally L-shaped in cross-section having a leg portion and a foot portion, the leg portions facing one another, the foot portions overlapping and forming the back portion of the gripping structure.

14. A hands-free long-gun carrying device, comprising:

a support plate supported at a user's chest; and a gripping structure on the support plate configured to releasably engage and support a long-gun in a port arms position, the gripping structure comprising:

a back portion;

upper and lower spaced apart resiliently deflectable jaw members defining an opening facing substantially forward relative to the user's chest, the upper jaw member having an upper jaw portion, the lower jaw member having a lower jaw portion;

the back and jaw members configured to resiliently receive therein a receiver of the long-gun with the long-gun in the port arms position such that the back portion engages a rear surface of the receiver, the upper jaw portion engages an upper surface of the receiver, and the lower jaw portion engages a lower surface of the receiver.

* * * * *